US005876515A

United States Patent [19]

Värpiö

[11] Patent Number: 5,876,515

[45] Date of Patent: Mar. 2, 1999

[54] METHOD OF WASHING ITEMS IN A WASHING LINE AND WASHING APPARATUS

[76] Inventor: Timo Värpiö, Pohjolantie 3 G 26, FIN-33430 Vuorentausta, Finland

[21] Appl. No.: 732,427

[22] PCT Filed: Apr. 27, 1995

[86] PCT No.: PCT/FI95/00231

§ 371 Date: Nov. 1, 1996

§ 102(e) Date: Nov. 1, 1996

[87] PCT Pub. No.: WO95/29625

PCT Pub. Date: Nov. 9, 1995

[30] Foreign Application Priority Data

May 2, 1994 [FI] Finland ..... 942018

[51] Int. Cl.[6] ..... A45B 19/12

[52] U.S. Cl. ..... 134/25.11; 134/25.2; 134/70; 134/72; 134/5 D

[58] Field of Search ..... 134/25.1, 25.2, 134/70, 72, 57 D

[56] References Cited

U.S. PATENT DOCUMENTS

| | | | |
|---|---|---|---|
| 4,334,547 | 6/1982 | Diebel et al. | 134/46 |
| 4,357,176 | 11/1982 | Anthony | 134/18 |
| 4,561,904 | 12/1985 | Eberhardt, Jr. | 134/18 |
| 5,259,889 | 11/1993 | Payzant | 134/15 |

FOREIGN PATENT DOCUMENTS

| | | |
|---|---|---|
| 3319832 | 6/1984 | Germany . |
| 2087717 | 6/1982 | United Kingdom . |
| 8301187 | 4/1986 | WIPO . |

*Primary Examiner*—Kriellion S. Morgan
*Attorney, Agent, or Firm*—Oldham & Oldham Co. L.P.A.

[57] ABSTRACT

A Method for washing items in an automatic washing line, and an automatic washing apparatus. When items (1) are conveyed to a washing zone (2), the method uses a sensor (6*a*) for detecting if there is a continuous flow of items (1) to the washing zone (2). If there is a break in the flow of items, washing in the washing zone (2) is interrupted. The apparatus comprises a sensor (6*a*) for detecting if there is a continuous flow of items (1) to be washed to the washing zone (2). In addition the apparatus comprises a program for interrupting the wash in the washing zone (2) when the sensor (6*a*) detects a break in the flow of items (1) to be washed.

21 Claims, 2 Drawing Sheets

METHOD OF WASHING ITEMS IN A WASHING LINE AND WASHING APPARATUS

CROSS-REFERENCE TO RELATED APPLICATIONS

Not applicable.

BACKGROUND OF THE INVENTION

The invention relates to a method for washing items in an automatic washing line wherein the items to be washed are conveyed to a washing zone in succession and a sensor is used to detect the presence of an item in the sensor area of the sensor.

The invention also relates to an automatic washing apparatus for washing items, the apparatus comprising an accumulation area for accumulating items to be washed in succession into a line, a conveyor in the accumulation area for conveying the items to the washing zone, and a sensor for detecting the presence of an item in the sensor area of the sensor.

In institutional kitchens, such as hotel or restaurant kitchens, large quantities of dishes are washed daily. Washing is effected by placing the dishes in racks which are conveyed through a washing line. Such washing lines usually comprise prewash, main wash and rinsing.

The operating costs of a washing line consist of water, energy and detergent consumed. Previously attention has not been paid to what the idle running costs of such a washing line may be. Unexpectedly, calculations show that the idle running costs of a kitchen washing e.g. 500 standard-sized racks daily may, at worst, exceed FIM 100.000 per year.

Idle running is caused by the wash running although no racks are conveyed through the line or there is space between the racks. With the line empty, water, energy and detergents are wasted.

BRIEF SUMMARY OF THE INVENTION

It is an object of the present invention to provide a method enabling a cut in operating costs by decreasing idle running. To obtain this goal, the method of the invention is characterized in that when the items are conveyed to the washing zone, a sensor is used to detect the presence of a new item essentially immediately after the last item which has passed the sensor area of the sensor, and in case of non-presence of a new item, washing in the washing zone is interrupted until the next item input towards the washing zone has reached the item that has passed the sensor area of the said sensor.

It is a further object of the present invention to provide an apparatus for washing items, the apparatus allowing the realization of the above economical method that will save operating costs. The apparatus of the invention is characterized in that it comprises the sensor which is arranged to detect if there is a new item essentially immediately after the item which has passed the sensor area, and in addition the washing apparatus comprises a programme which will interrupt the wash in the washing zone on the basis of information supplied by the sensor regarding the non-presence of a new item. Additionally the apparatus may comprise a separate sensor for detecting the location of the last item on line, whereby a programme will give a command to stop the wash programme in the washing zone on the basis of information supplied by the sensor. Correspondingly the location of the first item may be detected by means of a suitable sensor whereby the wash programme will start once a new line reaches that point. A similar idea may also be used separately in the different sub-zones of the apparatus; sub-zones that have a separate wash programmes, e.g. prewash, main wash and rinsing.

It is an essential idea of the invention that washing takes place in the washing area mainly only when the area is filled with items to be washed, whereby detergent, water and electricity will be utilized in the best possible way. The washing of items in the washing zone is thus interrupted if the items are not followed by items to be washed and the wash is not completed until new items to be washed arrive in the washing zone as a continuation of the existing ones. According to a preferred embodiment, a certain quantity of items to be washed is assembled in succession, preferably a quantity corresponding to the length of the washing zone, and the wash is started when a full quantity of items, i.e. a group of items, is accumulated and waiting to be washed, and continues until a new group of items has wholly entered the washing zone. If new items to be washed continue to arrive as a continuation of the ones in the washing zone, washing will naturally continue until a gap is formed after the items to be washed.

In the following the invention will be described in greater detail with reference to the accompanying drawings, where

BRIEF DESCRIPTION OF THE SEVERAL VIEWS OF THE DRAWINGS

FIG. 1 shows an ordinary washing line installed into an institutional kitchen, where dishes are washed by placing them in separate items 1, such as standard-sized plastic racks, which are conveyed through a line. The washing apparatus comprises an accumulation area 7, which may be a normal loading and input table for dishes, the area comprising a conveyor 4 at one edge for conveying the dishes to a washing zone 2. Dish washing machines are situated in the washing zone 2, i.e. a prewash machine in the first sub-zone 2*a* and a main washing machine, comprising a washing section forming the second sub-zone 2*b*, where detergent is also administered, and a rinsing section comprising the last washing zone 2*c*, where the washed dishes are rinsed. The above are followed by a discharge line 8 for assembling the washed items 1.

Figure 1:
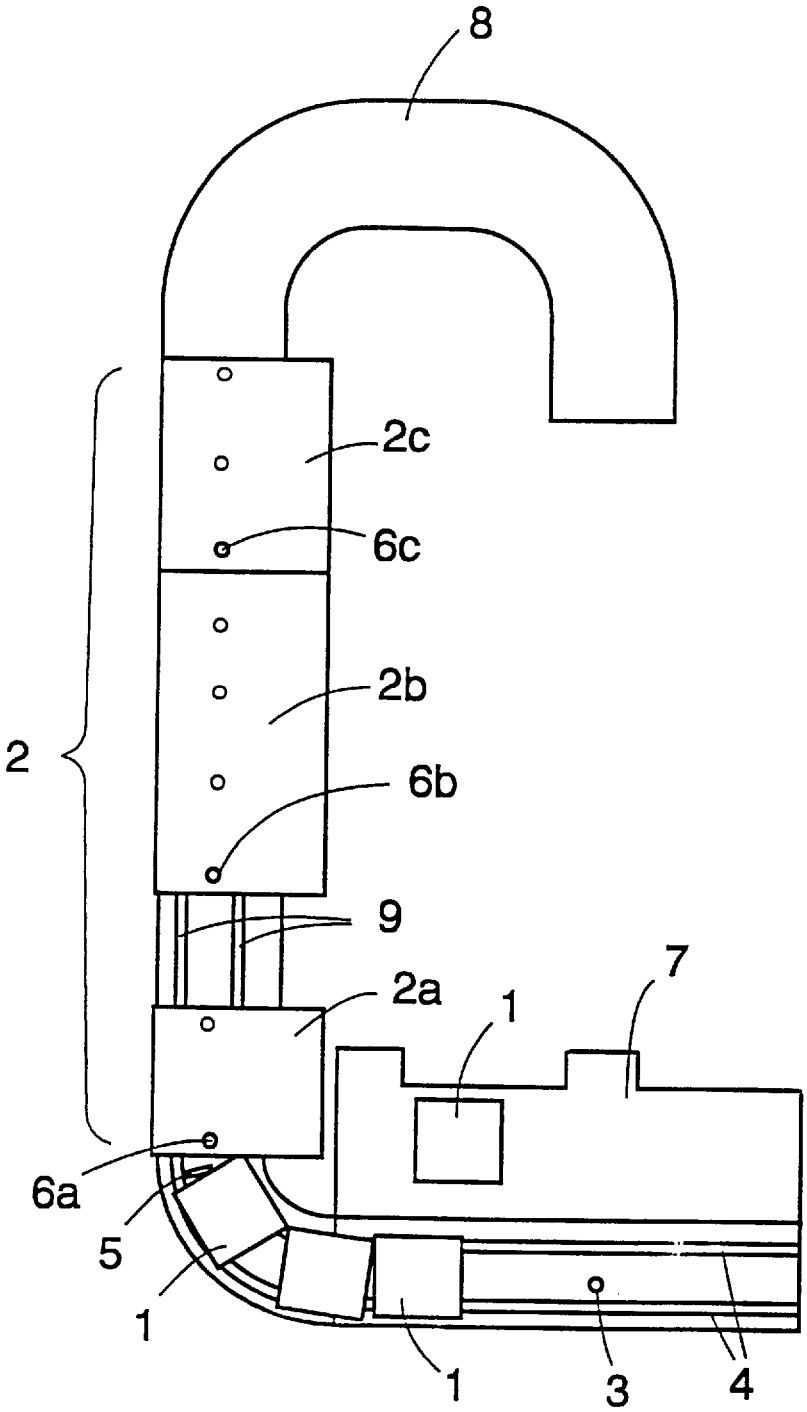
FIG. 1 is a schematic top view of the apparatus of the invention.

The conveyor 4 of the accumulation area and the conveyor 9 of the washing zone 2 are separate conveyors. The discharge line 8 may additionally have a separate conveyor.

The washing zone 2 is preceded by a mechanical retainer 5, a sensor 3 on the conveyor 4, and there are other sensors 6*a*–6*c* in the washing zone 2, the functions of which are described below.

DETAILED DESCRIPTION OF THE INVENTION

The operation of the apparatus is such that when washing is started, the items 1 to be washed are transferred via the loading and input table to the conveyor, where they are in succession in a line. The conveyor keeps running all this time, and the mechanical retainer 5 preceding the washing zone 2 will stop the items 1 from proceeding to the washing zone, which will thus result in the items being in close contact. At this point the wash programme in the washing zone 2 is not running. The sensor 3 on the conveyor 4 detects that a certain quantity of items has accumulated and respective information is transmitted by means of an automatic programme to the retainer 5, which will retract, and the conveyor 4 is thus able to convey the line to the washing zone and to the conveyor 9, where the items first enter the prewash machine, i.e. sub-zone 2*a*. A sensor 6*a* is also located in the first washing zone 2*a*, and it will detect the end of the line that has passed its sensor area, and this information is again transmitted to devices which will stop the wash programme. In accordance with the same principle, also the subsequent sub-zones 2*b* and 2*c* may have separate sensors 6*b* and 6*c* which will detect the arrival of the line to the sub-zone, and this information is transferred to devices which will start the wash programme of that particular sub-zone, and similarly they will detect the end of the line, and this information is transferred to devices which will stop the wash programme.

Normally the wash proceeds after the start so that there is a continuous flow of items 1 to be washed in all the washing zones 2*a*–2*c*, and the wash will continue so long as a new item 1 to be washed will follow essentially immediately after the item 1 to be washed arriving in the washing zone 2. If there is a gap after an item 1 arriving to the washing zone 2, the probe 6*a* will detect the non-presence of a new item 1 to be washed, and the wash in the whole washing zone 2 is interrupted until a new item 1 to be washed reaches the last item to have arrived to the washing zone 2 on the conveyor. Hereafter the wash will restart until the probe 6*a* again detects a gap after an item 1 having arrived in the washing zone 2.

Timing may be effected so that a predefined quantity of items 1 is allowed to be accumulated in the accumulation area 7, whereafter the group of items formed by items 1 in succession is forwarded in one go in accordance with the wash speed to the washing zone. The wash is similarly interrupted after the last item 1 of the group of items has passed the probe 6*a*, and the wash is not restarted until a new group of items of a predetermined size is formed. The sensor 3 detects the formation of such a group of items and thereafter gives a starting command to transfer the group of items forward, and when the line reaches the probe 6*a* the latter will give a command to restart the wash in the washing zone 2.

When the wash is finished the last items 1 may be washed although no new item 1 follows. The apparatus comprises a separate switch or control for this purpose in order to override the stop command given by the probe 6*a*. In addition the apparatus may comprise either an extra probe at the end of each separate sub-zone 2*a*–2*c* or timers which will stop the wash in a certain sub-zone after a certain time has passed from the moment when the last item 1 passed the probe 6*a*–6*c* of the respective washing zone.

The sensors 6*a*–6*c* may be arranged at sufficiently short intervals in the washing zone 2 to ensure sufficient information on the location of the items 1 at the different points of the washing line.

The automation of the apparatus may be arranged using probe and control solutions known per se. The sensors may be e.g. capacitive approach sensors, which will notify if an item is at the location of the sensor. The apparatus comprises a logic unit, wherein all necessary information may be programmed and by means of which ad hoc programmes may be made. Additionally a monitoring programme may be used, which will record the consumption of cold water, hot water and detergent per item, whereby the performance of the apparatus may be monitored. The data may e.g. be visible at all times on a display monitor, which will also allow any deviations in certain optimum values to be detected, whereat the programme may be assigned to give an alarm.

Figure 2:
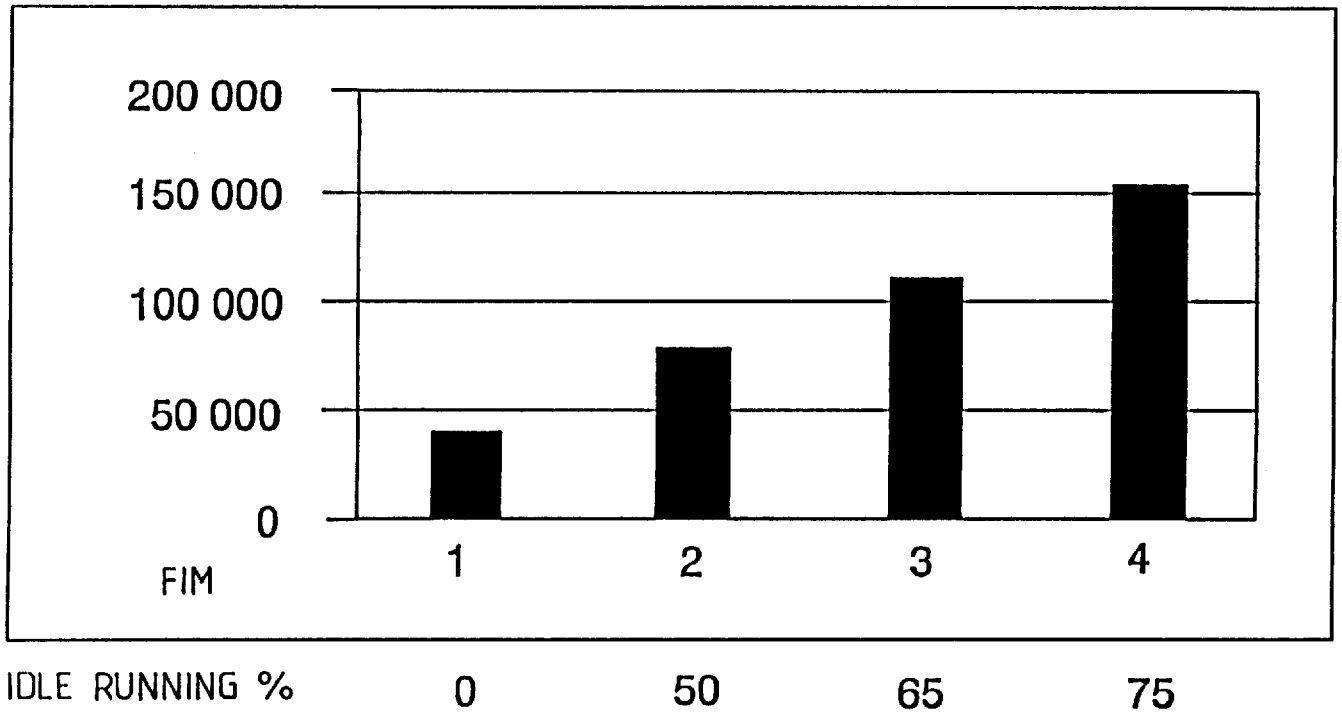
FIG. 2 illustrates the effect of idle running on the operating costs of a washing line.

FIG. 2 is a graph showing the effect of idle running on water, energy and chemical costs in FIM per year of a washer washing 600 racks per day in an institutional kitchen. Studies show that idle running constitutes typically 65% of the operating time. The graph shows that by the solution of the invention savings of tens of thousands of Finnmarks per year may be achieved.

The invention may be applied to existing washing apparatuses by making the necessary additions. The method is applicable to e.g. tunnel-type washing apparatuses of all sizes and all ages. An automatic prewash machine may additionally be installed to washing lines with previous manual prewash.

Instead of a separate mechanical retainer 5, the conveyor 9 of the washing zone may also function as a mechanical retainer so that when the conveyor 9 is shut off, it will keep the incoming items 1 from moving forward until the conveyor 9 is set in motion. Instead of a sensor located at the beginning of the washing zone, sensor 6*a* may also be a sensor or a detector preceding the washing zone, whereby the wash may be interrupted in case of non-presence of a new item immediately after the item in the sensor range of the sensor is leaving the sensor area. Instead of a separate probe, the sensor may also be some sort of a light beam transmitter-receiver set or other respective sensor able to detect the presence or non-presence of an item.

I claim:

1. A method for washing items in an automatic washing line wherein the items to be washed are conveyed to a washing zone in succession and a sensor is used to detect the presence of an item in a sensor area of the sensor, and that when the items are conveyed to the washing zone, the sensor is used to detect the presence of a new item essentially immediately after the last item which has passed the sensor area of the sensor, and in case of non-presence of a new item, washing in the washing zone and conveying of the items are essentially immediately interrupted until the next item input towards the washing zone has reached the item that has passed the sensor area of the said sensor.

2. The method as claimed in claim 1, wherein, on the basis of information from the sensor, a command is given to start a wash program in the washing zone when a new item has reached the item which has bypassed a sensor.

3. The method as claimed in claim 1 wherein the items are accumulated to a conveyor, which is running and precedes the washing zone, and a line of items thus formed is held in place until a predetermined quantity of items has accumulated, whereafter the line of items formed by the items is transferred towards the washing zone.

4. The method as claimed in claim 1 wherein the washing zone comprises sub-zones for special washing operations, and at least one of the sub-zones comprises a sensor for detecting the location of the first item in line for starting the wash program of the respective sub-zone and/or for detecting the location of the last item in line for ending the wash program of the respective sub-zone.

5. The method as claimed in claim 1 wherein the sensor is installed to detect essentially the leading edge of the washing zone so that the item to be detected has reached the washing zone before the non-presence of the next item is expressed.

6. An automatic washing apparatus for washing items, the apparatus comprising an accumulation area for accumulating items to be washed in succession into a line, a conveyor in the accumulation area for conveying the items to a washing zone, and a sensor for detecting the presence of an item in a sensor area of the sensor, and that the sensor is arranged to detect if there is a new item essentially immediately after the item which has passed the sensor area, and in addition the washing apparatus comprises a program which will essentially immediately interrupt the wash in the washing zone and the conveying of the items on the basis of information supplied by the sensor regarding the non-presence of a new item.

7. The apparatus as claimed in claim 6, whereby in connection with the conveyor there is a retainer for blocking the passage of the items to the washing zone, and a program will remove the retainer out of the way of the items once a predetermined quantity of items has accumulated to let them pass to the washing zone.

8. The apparatus as claimed in claim 7, wherein a sensor will detect when the last item in line has passed it, whereby a program will give a command to stop the wash program in the washing zone on the basis of the information supplied by the sensor.

9. The apparatus as claimed in claim 6 wherein the washing zone comprises sub-zones for special washing operations, and at least one of the sub-zones comprises a sensor for detecting the location of the first item in line, and a program will start a wash program corresponding to the washing operations of the sub-zone on the basis of the information of the sensor and/or a sub-zone comprises a sensor for detecting the location of the last item in line for ending a wash program corresponding to the washing operations of the sub-zone.

10. The apparatus as claimed in claim 6 wherein the washing zone comprises several sensors at certain intervals for detecting the locations of the items.

11. The method as claimed in claim 2 wherein the items are accumulated to a conveyor, which is running and precedes the washing zone, and a line of items thus formed is held in place until a predetermined quantity of items has accumulated, whereafter the line of items formed by the items is transferred towards the washing zone.

12. The method as claimed in claim 2 wherein the washing zone comprises sub-zones for special washing operations, and at least one of the sub-zones comprises a sensor for detecting the location of the first item in line for starting the wash program of the respective sub-zone and/or for detecting the location of the last item in line for ending the wash program of the respective sub-zone.

13. The method as claimed in claim 2 wherein the sensor is installed to detect essentially the leading edge of the washing zone so that the item to be detected has reached the washing zone before the non-presence of the next item is expressed.

14. The method as claimed in claim 3 wherein the washing zone comprises sub-zones for special washing operations, and at least one of the sub-zones comprises a sensor for detecting the location of the first item in line for starting the wash program of the respective sub-zone and/or for detecting the location of the last item in line for ending the wash program of the respective sub-zone.

15. The method as claimed in claim 3 wherein the sensor is installed to detect essentially the leading edge of the washing zone so that the item to be detected has reached the washing zone before the non-presence of the next item is expressed.

16. The method as claimed in claim 4 wherein the sensor is installed to detect essentially the leading edge of the washing zone so that the item to be detected has reached the washing zone before the non-presence of the next item is expressed.

17. The apparatus as claimed in claim 7, characterized in that the washing zone comprises sub-zones for special washing operations, and at least one of the sub-zones comprises a sensor for detecting the location of the first item in line, and a program will start a wash program corresponding to the washing operations of the sub-zone on the basis of the information of the sensor and/or a sub-zone comprises a sensor for detecting the location of the last item in line for ending a wash program corresponding to the washing operations of the sub-zone.

18. The apparatus as claimed in claim 7 wherein the washing zone comprises several sensors at certain intervals for detecting the locations of the items.

19. The apparatus as claimed in claim 8 wherein the washing zone comprises sub-zones for special washing operations, and at least one of the sub-zones comprises a sensor for detecting the location of the first item in line, and a program will start a wash program corresponding to the washing operations of the sub-zone on the basis of the information of the sensor and/or a sub-zone comprises a sensor for detecting the location of the last item in line for ending a wash program corresponding to the washing operations of the sub-zone.

20. The apparatus as claimed in claim 8 wherein the washing zone comprises several sensors at certain intervals for detecting the locations of the items.

21. The apparatus as claimed in claim 9 wherein the washing zone comprises several sensors at certain intervals for detecting the locations of the items.

* * * * *